US005127903A

United States Patent [19]

Mailot et al.

[11] Patent Number: 5,127,903

[45] Date of Patent: Jul. 7, 1992

[54] DEVICE FOR DISPENSING MEDICAMENTS TO INFANTS

[76] Inventors: Kevin G. Mailot, 3285 S. Cincinnati #487; Steven O. Lusk, 2227 S. Garnett, both of Tulsa, Okla. 74129

[21] Appl. No.: 525,979

[22] Filed: May 22, 1990

[51] Int. Cl.[5] ..... A61J 7/00; A61J 11/00

[52] U.S. Cl. ..... 604/77; 606/236

[58] Field of Search ..... 604/77; 606/234, 235, 606/236

[56] References Cited

U.S. PATENT DOCUMENTS

| | | | |
|---|---|---|---|
| 823,076 | 6/1906 | Pinsent | 604/77 |
| 3,610,248 | 10/1971 | Davidson | 606/236 |
| 4,078,566 | 3/1978 | Urban, Jr. | 604/77 X |
| 4,192,307 | 3/1980 | Baer | 606/236 |
| 4,430,075 | 2/1984 | Urban et al. | 604/77 |
| 4,447,164 | 5/1984 | Berndt | 606/234 |
| 4,915,242 | 4/1990 | Marte | 604/77 X |

*Primary Examiner*—William H. Grieb

[57] ABSTRACT

This is a device for delivering medicaments to infants by means of a dispenser in a pacifier. The dispenser regulates the rate of medicament released by using semipermeable membranes or capillary tubes. As the child or infant suckles on the pacifier, a flow of saliva bathes the dispenser and mixes with the dispensed medicaments.

18 Claims, 1 Drawing Sheet

DEVICE FOR DISPENSING MEDICAMENTS TO INFANTS

SUMMARY OF THE INVENTION

This is a device for delivering medicaments to infants by means of a delivery system incorporated into a pacifier.

"Medicament" as used herein means any compositions which are typically administered to infants. Therefore, "medicaments" includes fluorides, cough medicine, aspirin, penicillin, or the like, and even including flavors having no biological action other than taste. The device is particularly applicable for the administration of fluoride to infants and will be described as it is used for this specific purpose, it being understood that such is by way of example only and not by way of limitation.

The intent of the delivery system is not to replace community or school fluoridation programs for the young, rather it is to be used to augment and supplement where these methods are inadequate. Specifically, it is intended to be a means of supplying fluoridation to children who reside in non-fluoridated communities. Secondly, it is designed to supply both a topical and a systemic effect which currently is not possible in the infant/child. Thirdly, it is designed to deliver these beneficial health measures at a time in tooth development which will result in the greatest reduction in dental caries. Finally, the device is intended to serve as a more reliable and parentally accepted means of supplemental fluoridation. That is, by using a pacifier-type design which is already socially and culturally accepted, parental compliance will be greatly enhanced. The device will take advantage of most infants natural tendency to suckle. The incorporation of a long term, slow release device will keep manual intervention to a minimum.

The design of the device includes an orthodontically correct pacifier with a delivery system within. The delivery system contains one or more compartments separated by membranes and having an array of capillary tubes. This acts as a means for regulating the amount of medicament, such as fluoride, released. The membranes help in the regulation of the fluoride ion flow by using the properties of ion size, concentration, osmosis, diffusion, pressure gradients and charge. The capillary tubes help in regulation of the fluoride ion flow by using the properties of laminar flow, Bernoullis' equation, surface tension, viscosity, etc. As the infant/-child suckles, a continuous minute amount of fluoride will be released into the saliva bathing the primary teeth with fluoride. This will act as a low level, continuous topical application which is the best possible means of topical fluoride application. Secondly, the fluoride will be ingested to perform its second function, that being systemic application. It is by this means that the critical period of fluoride application will not be ignored in the non-fluoridated populations unwilling or unable to fluoridate.

DESCRIPTION OF THE PREFERRED EMBODIMENTS

Figure 1:
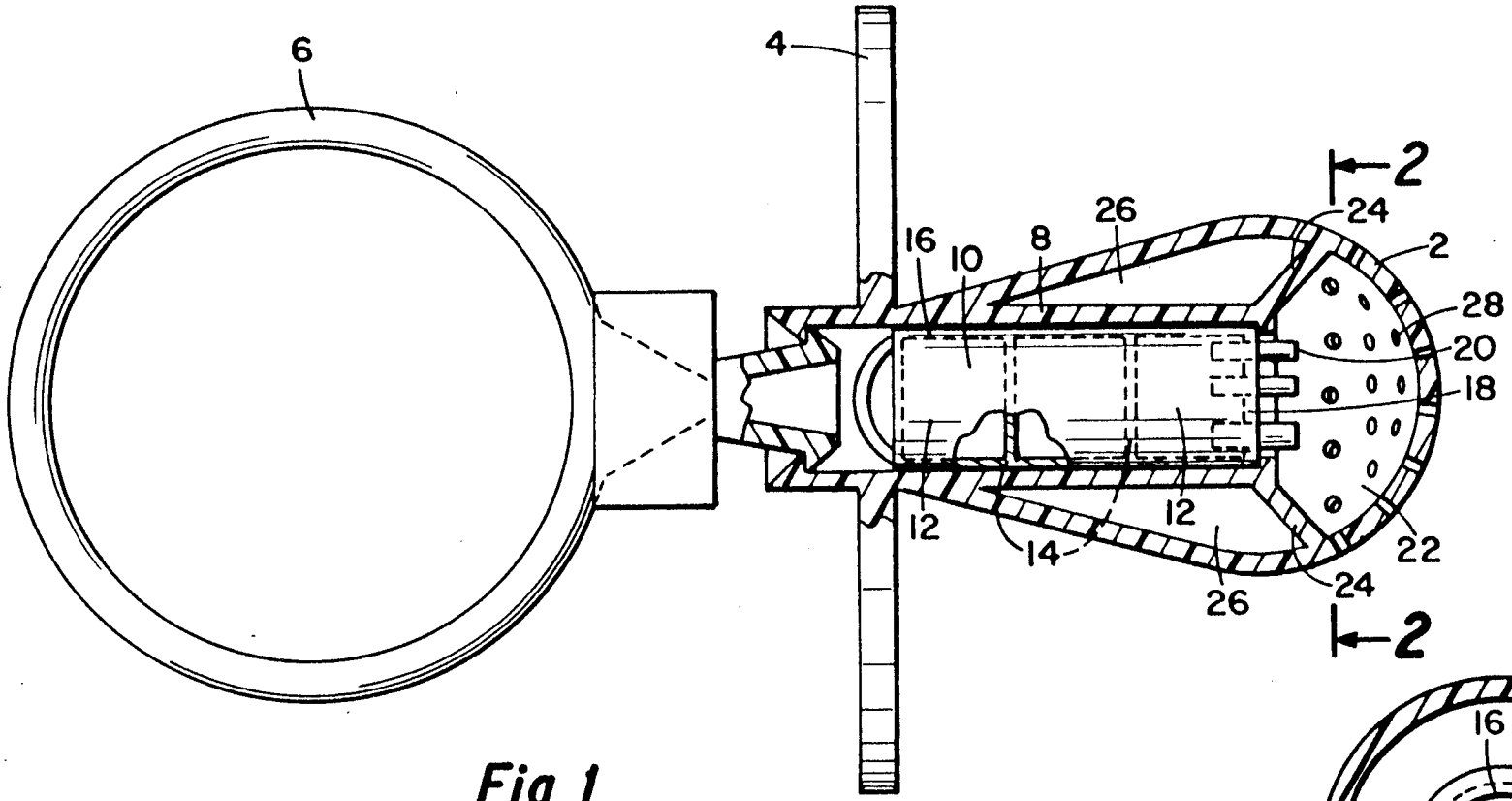
FIG. 1 is a longitudinal sideview of the device of this disclosure shown partially in cross-section.
Figure 2:
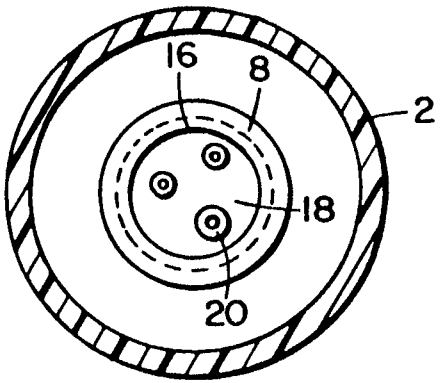
FIG. 2 is a section of the device as disclosed when sectioned at line A—A in FIG. 1.

An orthodontically correct pacifier consisting of the usual nipple 2, disc 4 and ring 6 is modified to include a receptacle chamber 8. The chamber holds an insert unit 10 having one or more internal compartments 12 which are separated by membranes(s) 14 The insert unit is surrounded by a casing 16. The end casing of an insert 18 is perforated by one or more capillary tubes 20 which extend from internal compartments 12 into a nipple chamber 22 between end casing 18 and nipple 2. The capillary tubes 20 may be constructed of any suitable material and the number, length and diameter may be varied to produce the desired release rate. The membrane(s) 14 can be varied to produce the desired flow rate.

The internal compartment(s) 12 contain a medicament, such as a fluoride ion source, that may be selected from the numerous commercially available fluoride ion sources. More than one source may be used in the device. Illustrative fluoride ion sources include, but are not limited to, NaF, Sn2F, Na(PO3)F.

An indicator dye may be incorporated in compartment(s) 12 with the fluoride ion source to act as a visible indicator or exhaustion of the fluoride ion Source. Numerous commercially available dyes are available. Preference is given to those less expensive compatible with the working of the device. Illustrative dyes include, but are not limited to, methyl red, chlorophenol blue, and bromothymol blue.

Further structure may include an internal wall 24 which seals off the space 26. Wall 24 prevents pooling of saliva in space 26. Space 26 may be filled with any suitable resilent material.

In practice, the child or infant suckles on nipple 2. Saliva enters holes 28 and into nipple chamber 22. The saliva bathes the open ends of the capillary tube(s) 20 and medicament, such as fluoride ions, are released from internal compartment(s) 12, across membrane(s) 14, into capillary tube(s) 20 and into the saliva in nipple chamber 22. As suckling continues, there is a continuing exchange of saliva through holes 28.

We claim:

1. A device for dispensing medicaments to infants comprising:

a pacifier having a bulbous outer portion configured to be retained by sucking action within the mouth of an infant and having a medicament containing chamber therein; and a medicament containing insert vessel removably positionable within said medicament containment chamber in said pacifier providing means for controlled time release of medicaments.

2. A device for dispensing medicaments according to claim 1 in which said pacifier is an orthodontically correct pacifier.

3. A device for dispensing medicaments according to claim 1 in which said insert vessel has therein one or more semipermeable membranes dividing the insert vessel into compartments.

4. A device for dispensing medicaments according to claim 1 in which said insert vessel contains one or more capillary tubes.

5. A device for dispensing medicaments according to claim 1 in which said insert vessel contains, in addition to said medicaments, an indicator dye.

6. A device for dispensing medicaments to infants comprising:

a pacifier having a bulbous outer end configured to be retained by sucking action within the mouth of an infant;

a chamber within said pacifier bulbous outer end;

an insert vessel within said chamber;

means for controlled time release of medicaments from said insert vessel.

7. A device for dispensing medicaments according to claim 6 wherein said means for controlled time release of medicaments includes one or more selective semipermeable membranes within said insert vessel.

8. A device for dispensing medicaments according to claim 6 wherein said means for controlled time release of medicaments includes one or more capillary tubes extending from within said insert vessel.

9. A device for dispensing medicaments according to claim 6 wherein said means for controlled time release of medicaments includes a combination of semipermeable membranes and capillary tubes.

10. A device for dispensing medicaments to infants comprising:

a pacifier;

a chamber within said pacifier;

an insert vessel within said chamber;

one or more internal compartments within said insert vessel;

a medicament within at least one of said compartments;

at least one semipermeable membrane dividing said compartments; and at least one capillary tube extending from within said insert vessel to the exterior thereof.

11. A pacifier device for dispensing medicaments to infants, comprising:

a hollow bulbous shaped nipple member configured to be retaining by sucking action within the mouth of an infant and having one end with at least one small diameter opening therein and another end with a large diameter opening therein;

a disc member secured to said nipple member adjacent said end with said large diameter opening;

chamber means with said nipple member having communication with said large diameter opening and a vessel means adaptable to receive medicament therein and removably positionable within said chamber for dispensation of medicament through said at least one small diameter opening; and means to close said large diameter opening.

12. A pacifier device for dispensing medicament to infants according to claim 11 wherein said means to close said large diameter opening includes removable means.

13. A pacifier device for dispensing medicament to infants according to claim 11 including:

a hand hold member attached to said disc member on the side of said disc member opposite said nipple member.

14. A pacifier device for dispensing medicaments to infants according to claim 13 wherein said hand hold member is ring shaped.

15. A pacifier device for dispensing medicaments to infants according to claim 13 wherein said means to close said large diameter opening and said hold member are integral.

16. A pacifier device for dispensing medicaments to infants according to claim 11, wherein said nipple member and said disc member are integral.

17. A pacifier device for dispensing medicament to infants according to claim 11 wherein said nipple member, said disc member and said chamber means are integrally formed.

18. A pacifier device for dispensing medicaments to infants according to claim 11 wherein said insert vessel includes means for controlled time release of medicaments therefrom.

* * * * *